US011975938B2

(12) United States Patent
Takahashi et al.

(10) Patent No.: US 11,975,938 B2
(45) Date of Patent: May 7, 2024

(54) SHEET TRANSPORT DEVICE, IMAGE READING DEVICE, AND IMAGE FORMING APPARATUS

(71) Applicant: FUJIFILM Business Innovation Corp., Tokyo (JP)

(72) Inventors: Yosuke Takahashi, Kanagawa (JP); Masato Serikawa, Kanagawa (JP); Takakiyo Toba, Kanagawa (JP); Yuta Abe, Kanagawa (JP); Isamu Adachi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 578 days.

(21) Appl. No.: 16/542,280

(22) Filed: Aug. 15, 2019

(65) Prior Publication Data

US 2020/0299095 A1 Sep. 24, 2020

(30) Foreign Application Priority Data

Mar. 22, 2019 (JP) ..... 2019-054061

(51) Int. Cl.
*B65H 31/26* (2006.01)
*B65H 5/36* (2006.01)
(Continued)

(52) U.S. Cl.
CPC ..... *B65H 31/26* (2013.01); *B65H 5/36* (2013.01); *B65H 9/166* (2013.01); *B65H 29/52* (2013.01); *B65H 29/60* (2013.01)

(58) Field of Classification Search
CPC ..... B65H 31/3063; B65H 31/3054; B65H 31/30; B65H 31/24; B65H 29/64
See application file for complete search history.

(56) References Cited

U.S. PATENT DOCUMENTS 6,045,127 A * 4/2000 Fukui ..... B65H 31/24 271/305
7,942,414 B2 * 5/2011 Taki ..... G03G 15/6552 271/279

(Continued)

FOREIGN PATENT DOCUMENTS

JP 2002062693 2/2002
JP 2017165498 9/2017

OTHER PUBLICATIONS

"Office Action of Japan Counterpart Application" with English translation thereof, dated Nov. 22, 2022, p. 1-p. 5.

*Primary Examiner* — Howard J Sanders
(74) *Attorney, Agent, or Firm* — JCIPRNET

(57) ABSTRACT

A sheet transport device includes a transport unit, a load section, and a sheet accommodation section. The transport unit has a transport path along which a sheet read at a read position is transported to an output unit. The sheet output by the output unit is loaded onto the load section. The sheet accommodation section is disposed downstream in an output direction of the sheet from an inner wall surface extending upward adjacent to the load section and has a recess capable of accommodating a sheet of a predetermined minimum size. A retrieval space through which the sheet accommodated in the sheet accommodation section is retrievable is provided by exposing the transport path in a direction opposite to a loading direction of the sheet.

15 Claims, 10 Drawing Sheets

(51) Int. Cl.

| | |
|---|---|
| ***B65H 9/16*** | (2006.01) |
| ***B65H 29/52*** | (2006.01) |
| ***B65H 29/60*** | (2006.01) |

(56) References Cited

U.S. PATENT DOCUMENTS

| | | | | |
|---|---|---|---|---|
| 2010/0232857 | A1* | 9/2010 | Nakayama ..... | B65H 31/02<br>399/405 |
| 2021/0122599 | A1* | 4/2021 | Akiyama ..... | B65H 31/02 |

* cited by examiner

SHEET TRANSPORT DEVICE, IMAGE READING DEVICE, AND IMAGE FORMING APPARATUS

CROSS-REFERENCE TO RELATED APPLICATIONS

This application is based on and claims priority under 35 USC 119 from Japanese Patent Application No. 2019-054061 filed Mar. 22, 2019.

BACKGROUND

(i) Technical Field

The present disclosure relates to sheet transport devices, image reading devices, and image forming apparatuses.

(ii) Related Art

Japanese Unexamined Patent Application Publication No. 2002-62693 discloses a known automatic document feeding device provided with a feed tray on which a document to be fed to a read position is placed and an output tray that accommodates the document output after a reading process. The output tray is disposed below the feed tray. The automatic document feeding device performs an image reading process while the document is transported between the feed tray and the output tray. The automatic document feeding device has a mechanism for moving the document accommodated in the output tray toward the rear end of the output tray.

Japanese Unexamined Patent Application Publication No. 2017-165498 also discloses a known automatic document feeding device that feeds and transports documents one-by-one for reading images from the documents. The automatic document feeding device includes a first transport path for transporting a document from which an image is read to a first output position, a second transport path for transporting a document from which an image is read to a second output position provided above the first output position, a switching unit for transporting a document to either one of the first transport path and the second transport path in accordance with the size of the document, and an accommodation section for accommodating the documents output from the first output position and the second output position. The first transport path is used for transporting documents of smaller sizes than those in the second transport path.

SUMMARY

Aspects of non-limiting embodiments of the present disclosure relate to a sheet transport device, an image reading device, and an image forming apparatus that may facilitate retrieval of output small-size sheets, as compared with a configuration not having a retrieval space that allows for retrieval of sheets accommodated in a sheet accommodation section from upstream in the transport direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transport device including a transport unit, a load section, and a sheet accommodation section. The transport unit has a transport path along which a sheet read at a read position is transported to an output unit. The sheet output by the output unit is loaded onto the load section. The sheet accommodation section is disposed downstream in an output direction of the sheet from an inner wall surface extending upward adjacent to the load section and has a recess capable of accommodating a sheet of a predetermined minimum size. A retrieval space through which the sheet accommodated in the sheet accommodation section is retrievable is provided by exposing the transport path in a direction opposite to a loading direction of the sheet.

BRIEF DESCRIPTION OF THE DRAWINGS

Exemplary embodiments of the present disclosure will be described in detail based on the following figures, wherein.

DETAILED DESCRIPTION

The present disclosure will be described in further detail below with reference to exemplary embodiments and specific examples. However, the present disclosure is not to be limited to these exemplary embodiments and specific examples.

Furthermore, in the following description with reference to the drawings, it should be noted that the drawings are schematic and that the dimensional ratios are different from the actual dimensional ratios. For providing an easier understanding, components other than those necessary for the description are omitted, where necessary.

1. Overall Configuration and Operation of Image Forming Apparatus

Figure 1:
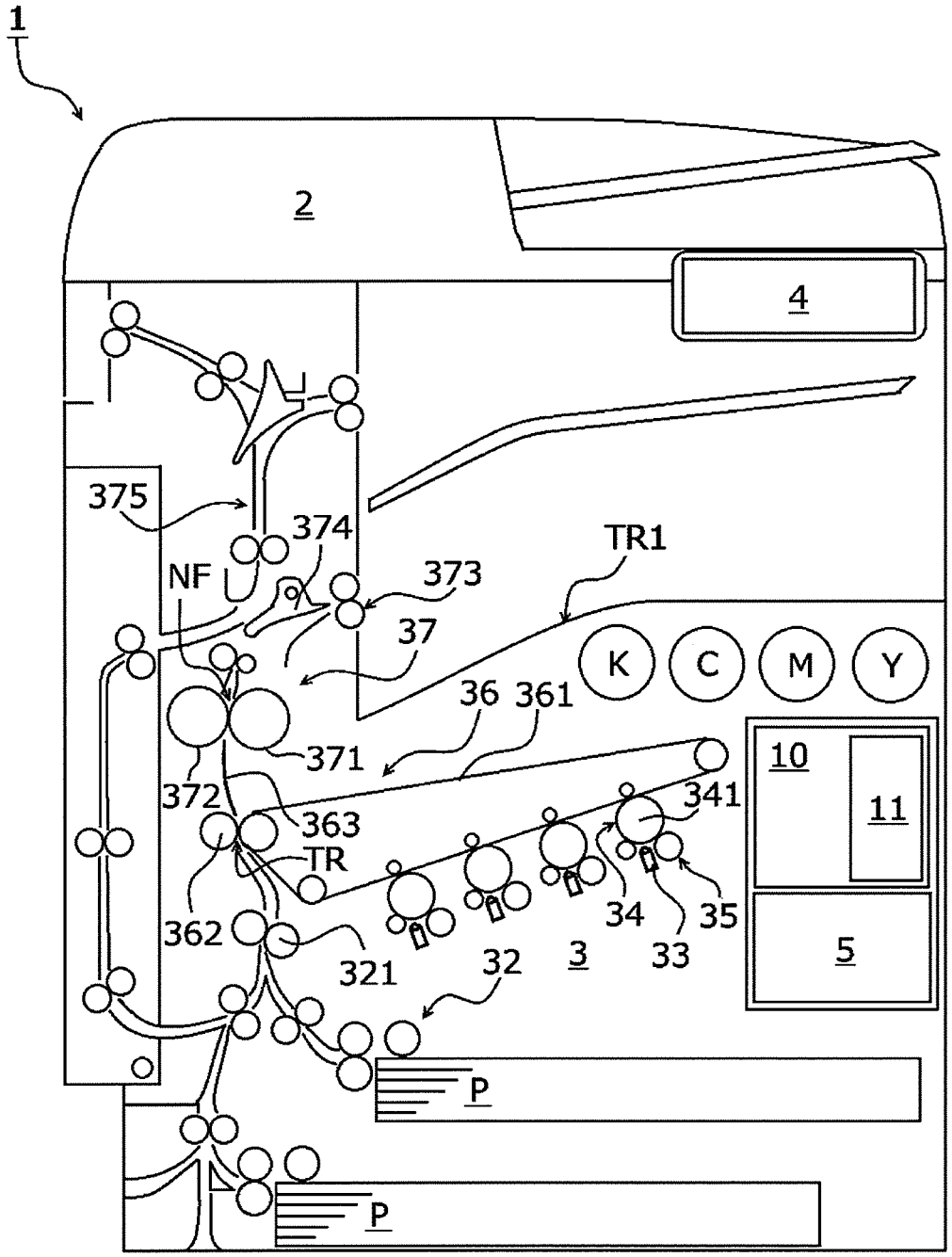
FIG. 1 is a cross-sectional view schematically illustrating the internal configuration of an image forming apparatus.
Figure 2:
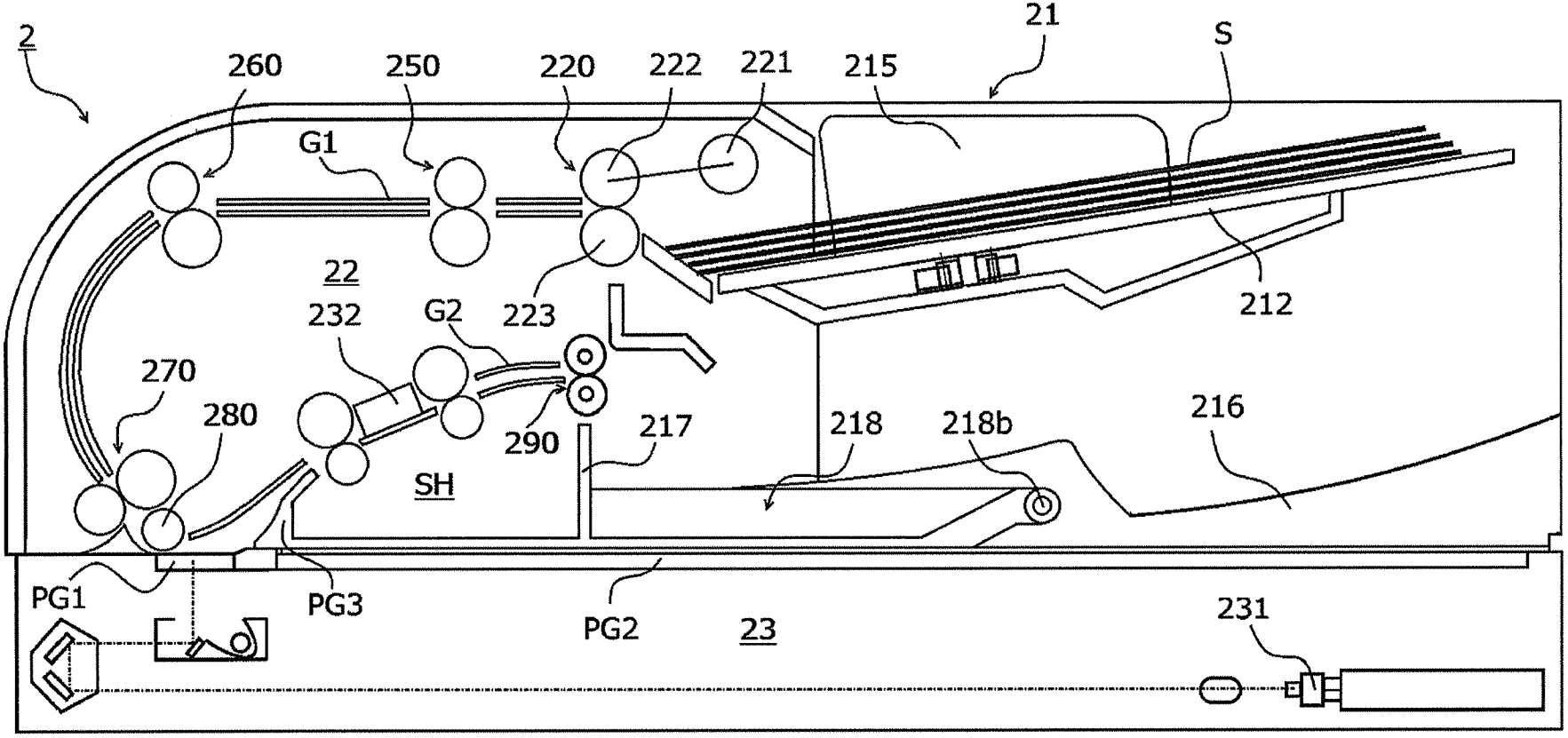
FIG. 2 is a cross-sectional view illustrating the internal configuration of an image reading device.
Figure 3:
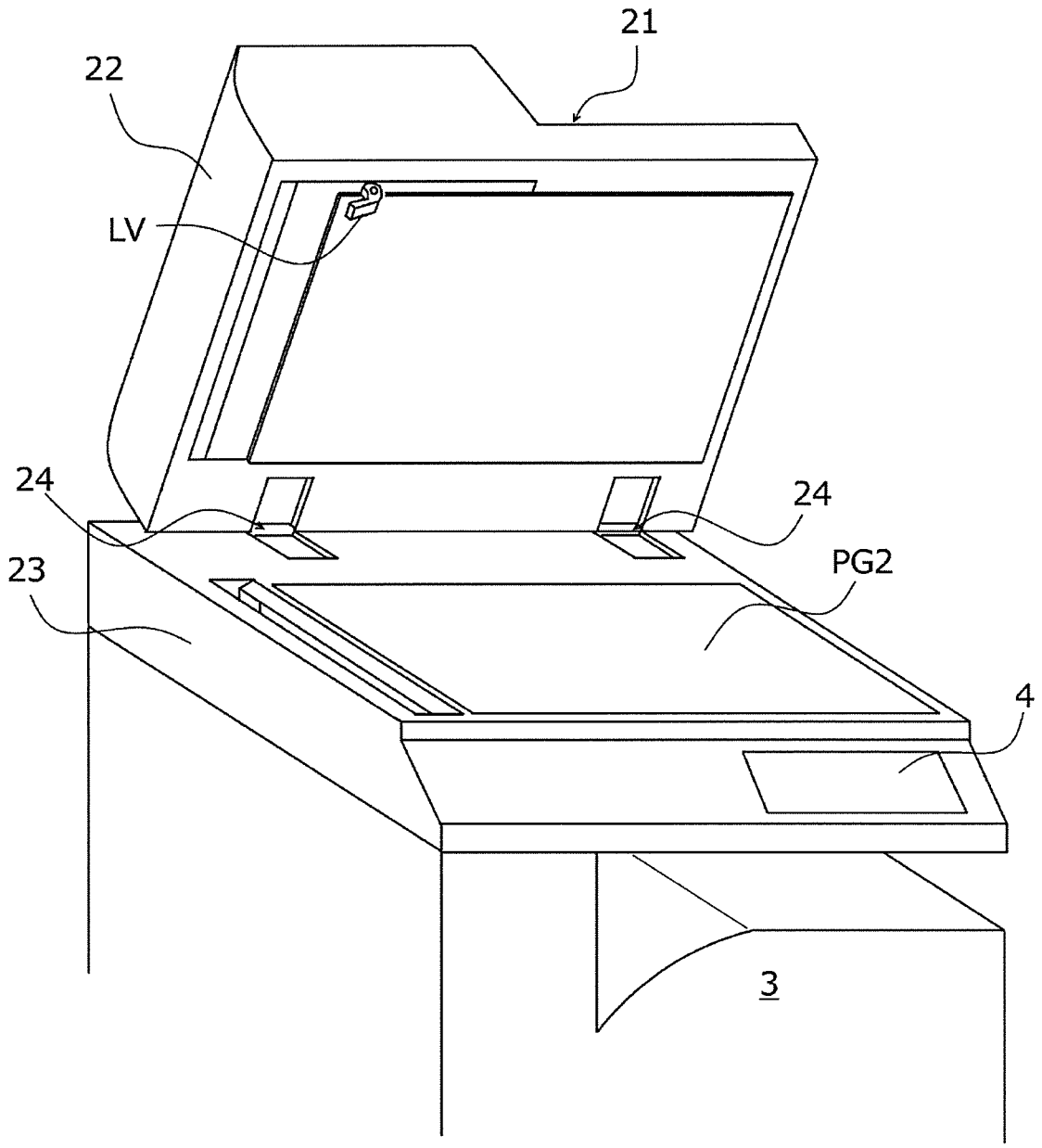
FIG. 3 is a perspective view illustrating a sheet load section and an automatic sheet feeder of the image reading device in a state where they are opened upward.

FIG. 1 is a cross-sectional view schematically illustrating the internal configuration of an image forming apparatus 1 according to an exemplary embodiment. FIG. 2 is a cross-sectional view illustrating the internal configuration of an image reading device 2. FIG. 3 is a perspective view illustrating a sheet load section 21 and an automatic sheet feeder 22 of the image reading device 2 in a state where they are opened upward. The overall configuration and the operation of the image forming apparatus 1 will be described below with reference to the drawings.

1.1. Overall Configuration

The image forming apparatus 1 includes the image reading device 2 that reads an image from a sheet S, such as a document, and converts it into image data, an image forming unit 3 as an image recorder that prints the read image data onto paper as a recording medium, an operational information unit 4 as a user interface, and an image processor 5.

The image reading device 2 includes the sheet load section 21, the automatic sheet feeder 22, and an image reader 23 as an example of an imaging unit. The automatic sheet feeder 22 transports the sheet S placed on the sheet load section 21 to a read position of the image reader 23. An image read by an image sensor (not shown), such as a charge-coupled device (CCD) line sensor, of the image reader 23 is converted into image data as an electric signal.

The image forming unit 3 includes a paper feeding device 32, exposure devices 33, photoconductor units 34, developing devices 35, a transfer device 36, and a fixing device 37, and forms image information received from the image processor 5 as a toner image onto paper P fed from the paper feeding device 32.

The operational information unit 4 as a user interface is disposed on the front surface of the image reading device 2. The operational information unit 4 is constituted of a combination of, for example, a liquid crystal display panel, various control buttons, and a touchscreen. A user of the image forming apparatus 1 may input various settings and a command via the operational information unit 4. Moreover, various types of information are displayed to the user of the image forming apparatus 1 via the liquid crystal display panel.

The image processor 5 generates image data from the image read by the image reading device 2 and from print information transmitted from an external apparatus (such as a personal computer).

1.2. Image Forming Unit

Paper P designated in a print job for each printing process is fed from the paper feeding device 32 to the image forming unit 3 in accordance with an image formation timing of the image forming unit 3.

The photoconductor units 34 individually include photoconductor drums 341 that are provided parallel to one another above the paper feeding device 32 and that are rotationally driven. The developing devices 35 form yellow (Y), magenta (M), cyan (C), and black (K) toner images on the corresponding photoconductor drums 341 having electrostatic latent images formed thereon by the exposure devices 33.

The toner images formed on the photoconductor drums 341 of the respective photoconductor units 34 are sequentially electrostatically transferred (first-transferred) onto an intermediate transfer belt 361 of the transfer device 36, so that a superposed toner image constituted of toners of the respective colors is formed. The superposed toner image on the intermediate transfer belt 361 is collectively transferred by a second-transfer roller 362 onto the paper P transported from a pair of registration rollers 321 and guided by a transport guide.

In the fixing device 37, a fixation nip FN (fixation region) is formed by a pressure contact area of a pair of heating module 371 and pressing module 372.

The paper P having the toner image collectively transferred thereon by the transfer device 36 is transported to the fixation nip FN of the fixing device 37 via a transport guide 363 in a state where the toner image is not fixed on the paper P yet. Then, the pair of heating module 371 and pressing module 372 fixes the toner image onto the paper P in accordance with heating and pressing functions.

The paper P having the fixed toner image formed thereon is guided to a switch gate 374 and is output from a first pair of output rollers 373 so as to be accommodated in a paper output tray TR1 at the upper surface of the image forming apparatus 1. If the paper P is to be inverted for duplex printing or is to be output with the image recorded face thereof facing upward, the transport direction of the paper P is switched toward a transport path 375 by the switch gate 374.

1.3. Image Reading Device

The image reading device 2 includes the sheet load section 21, the automatic sheet feeder 22, and the image reader 23. As shown in FIG. 3, the sheet load section 21 and the automatic sheet feeder 22 are connected to the image reader 23 such that they are openable and closable thereabove by a hinge mechanism 24.

The sheet load section 21 includes a sheet tray 212 on which one or more sheets S having images recorded thereon are placed.

The automatic sheet feeder 22 includes a nudger roller 221 that fetches the sheets S loaded on the sheet tray 212 sequentially from the top, and also includes a separator 220 constituted of a feed roller 222 and a retardation roller 223.

In the separator 220, the feed roller 222 and the retardation roller 223 form a pair that separates sheets S from each other, if multiple stacked sheets S are fed to a nip N, so as to transport the sheets S one-by-one to the image reader 23.

In a sheet transport path G1, a takeaway roller 250 is disposed at a position downstream of the feed roller 222 in the transport direction of the sheet S. The takeaway roller 250 transports the sheet S fed by the feed roller 222 to a pre-registration roller 260.

A registration roller 270 that adjusts the transport timing of the sheet S is disposed downstream of the pre-registration roller 260. The pre-registration roller 260 corrects a skew of the sheet S by forming a loop in a state where the leading edge of the sheet S is in abutment with the registration roller 270 in a stopped state. The registration roller 270 is rotationally driven in accordance with a timing for starting a reading process. In a state where the loop of the sheet S is maintained by the takeaway roller 250 and the pre-registration roller 260, the sheet S is pressed against a sheet passing surface PG1 by a platen roller 280 so that the front face of the sheet S is read by the image reader 23.

A sheet placement surface PG2 that supports a sheet S placed thereon by an operator is disposed to the right of the sheet passing surface PG1. A sheet guide PG3 is disposed between the sheet passing surface PG1 and the sheet placement surface PG2. The sheet S passing over the sheet passing surface PG1 is guided to the sheet guide PG3 so as to be transported to a read sensor 232. The sheet S whose front face is read by the image reader 23 is transported along a sheet transport path G2 while the rear face of the sheet S is read by the read sensor 232, and is output by an output roller 290 to an output tray 216 provided below the sheet load section 21.

An image reading sensor 231 that optically reads an image of a sheet S and converts it into an electric signal is provided below the sheet placement surface PG2. Specifically, the image reading sensor 231 reads an image from a sheet S passing over the sheet passing surface PG1 or from a sheet S set on the sheet placement surface PG2. The read image is converted into image data as an electric signal.

2. Configuration and Operation of Output Tray

Figure 4:
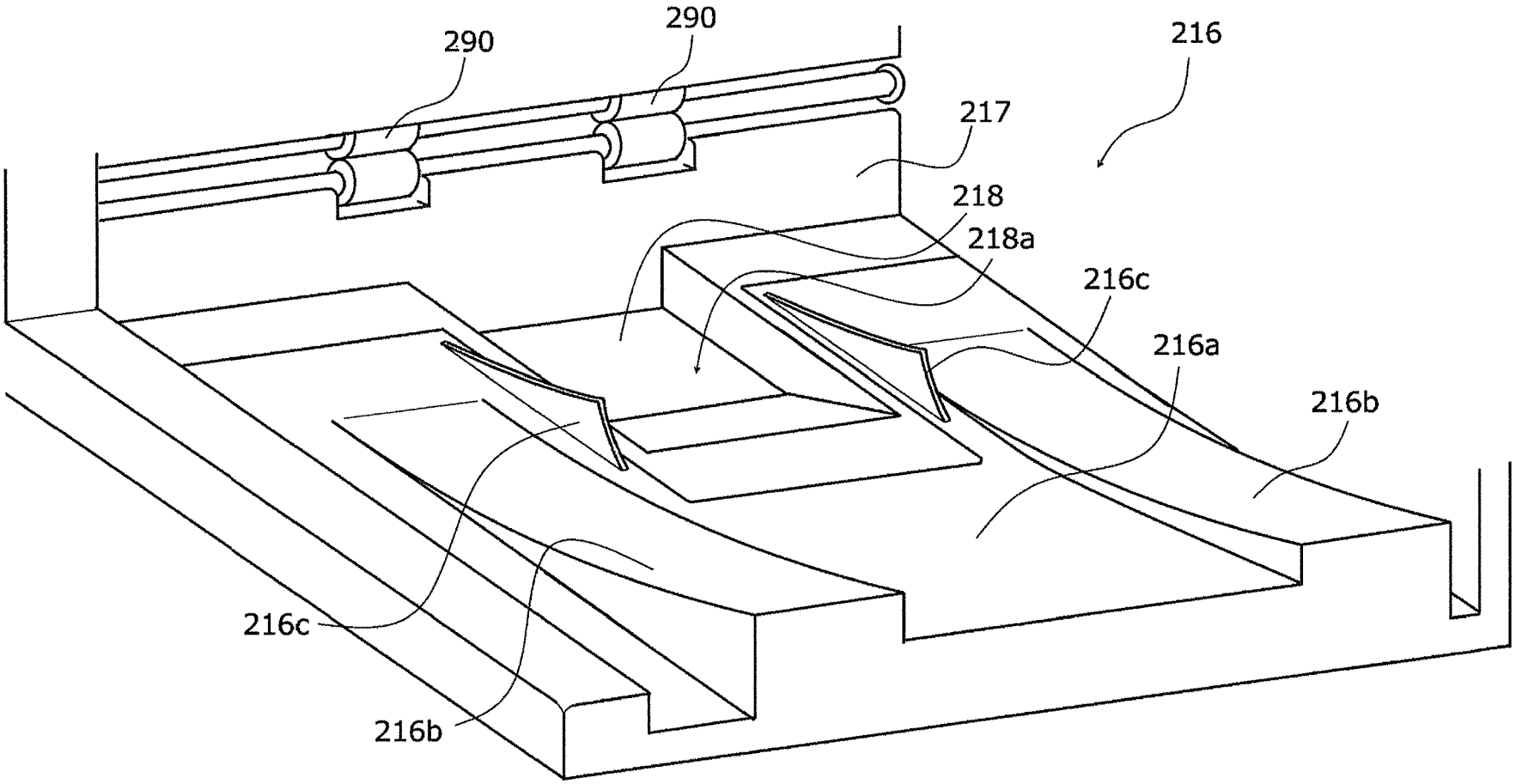
FIG. 4 is a perspective view illustrating an output tray of the image reading device.
Figure 5:
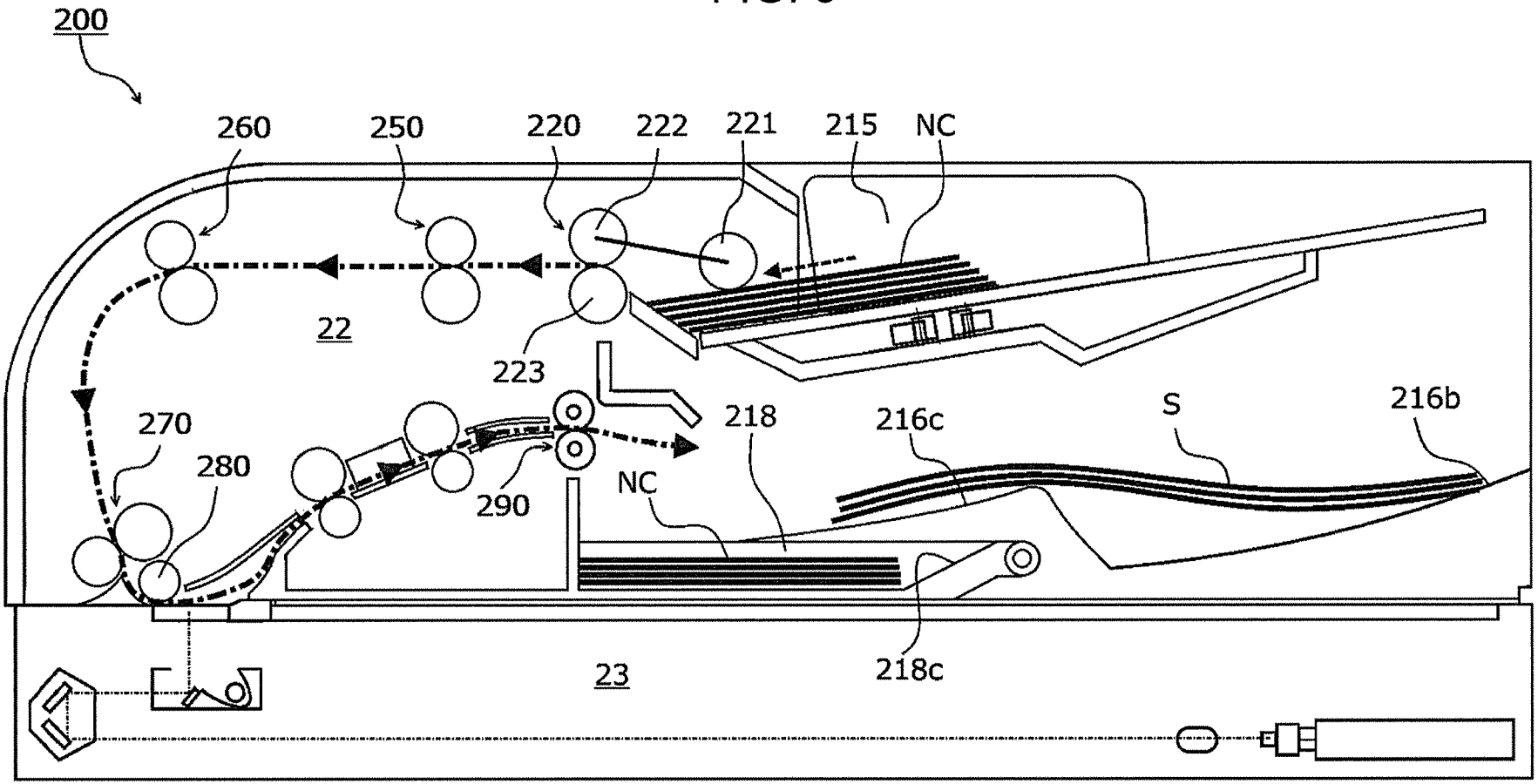
FIG. 5 is a cross-sectional view schematically illustrating how sheets are transported in the image reading device.
Figure 6:
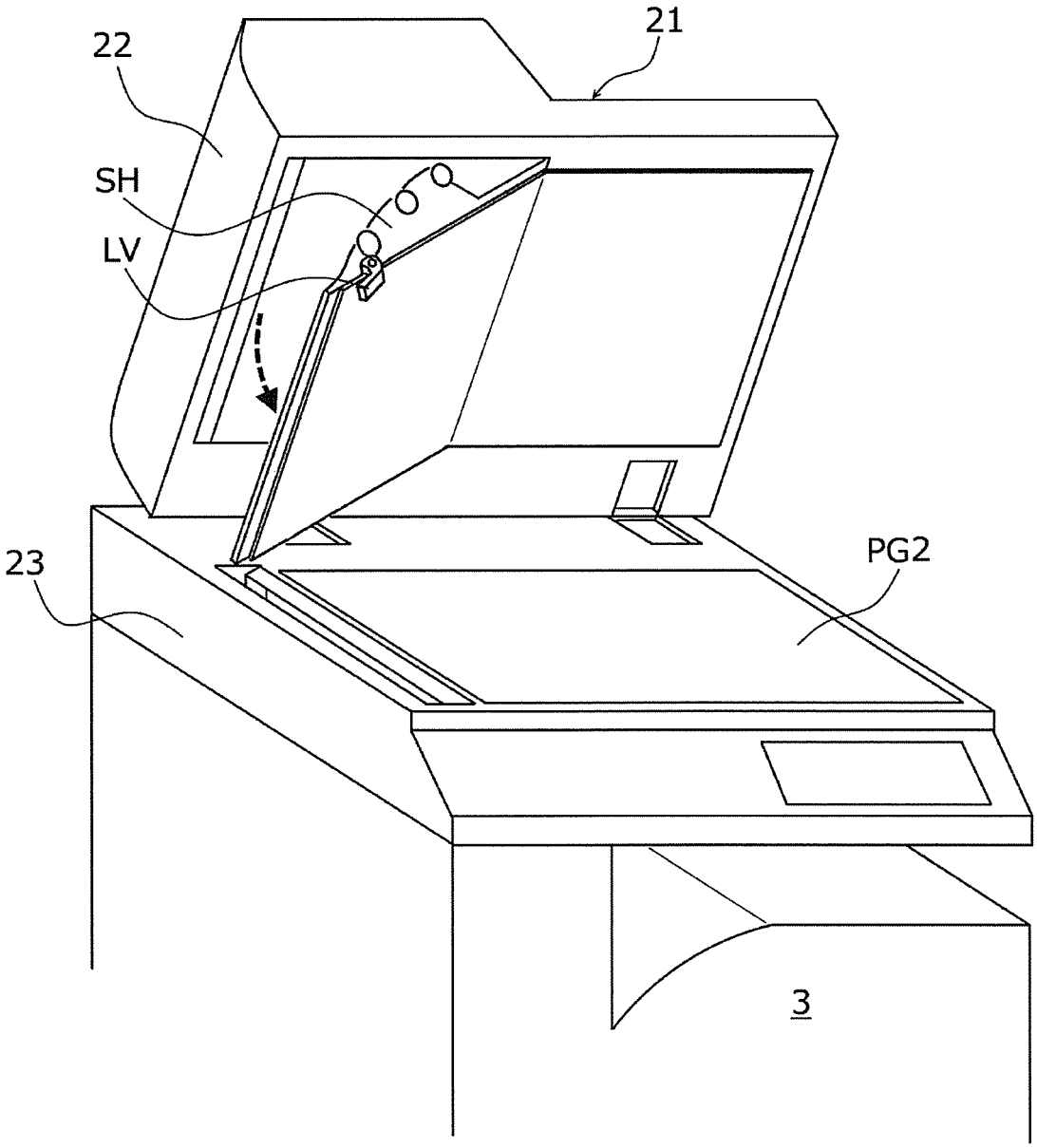
FIG. 6 is a perspective view illustrating a state where a sheet transport path of the automatic sheet feeder is exposed by raising the sheet load section and the automatic sheet feeder upward.
Figure 7:
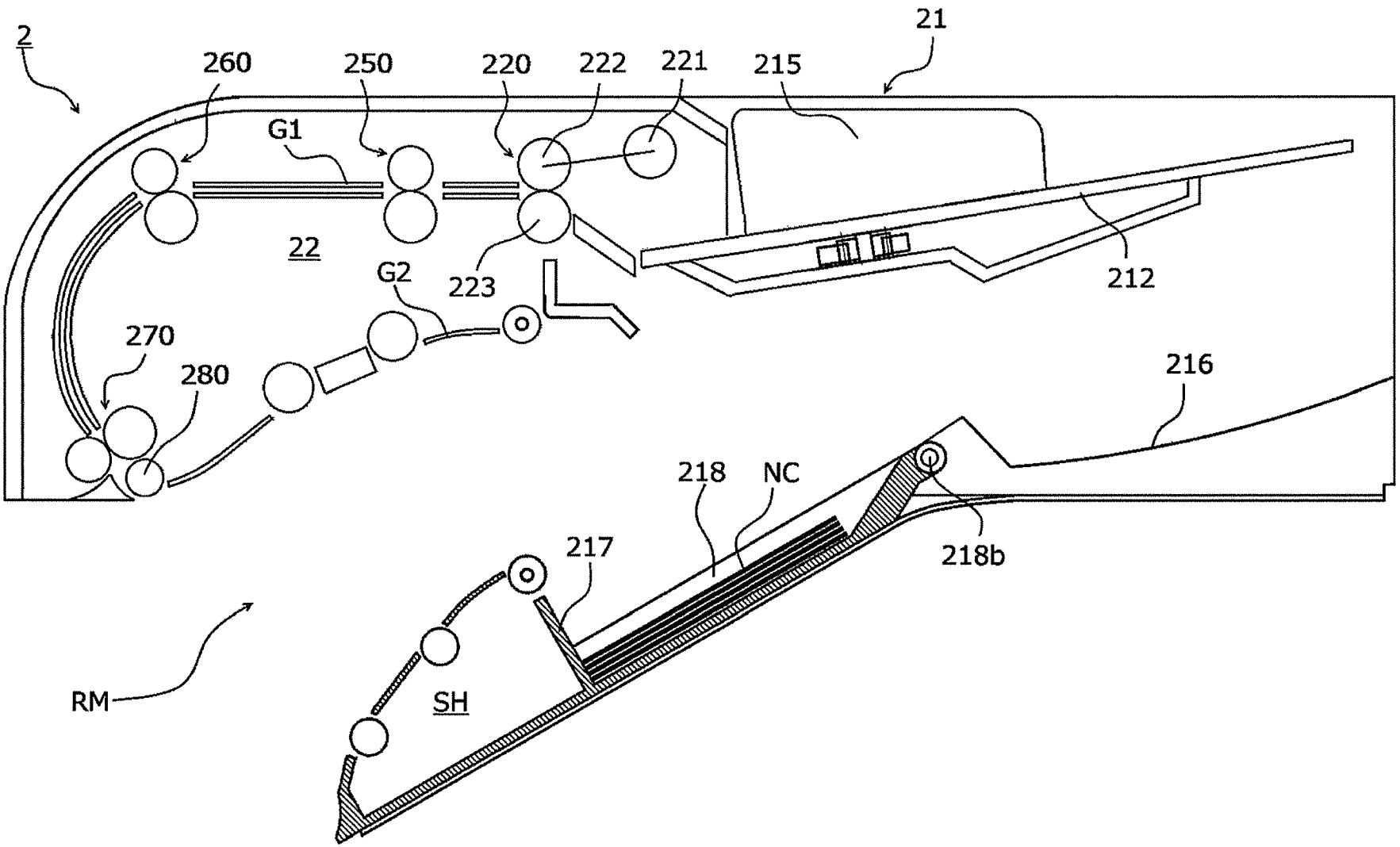
FIG. 7 is a cross-sectional view schematically illustrating the image reading device in a state where the sheet transport path is exposed.
Figure 10:
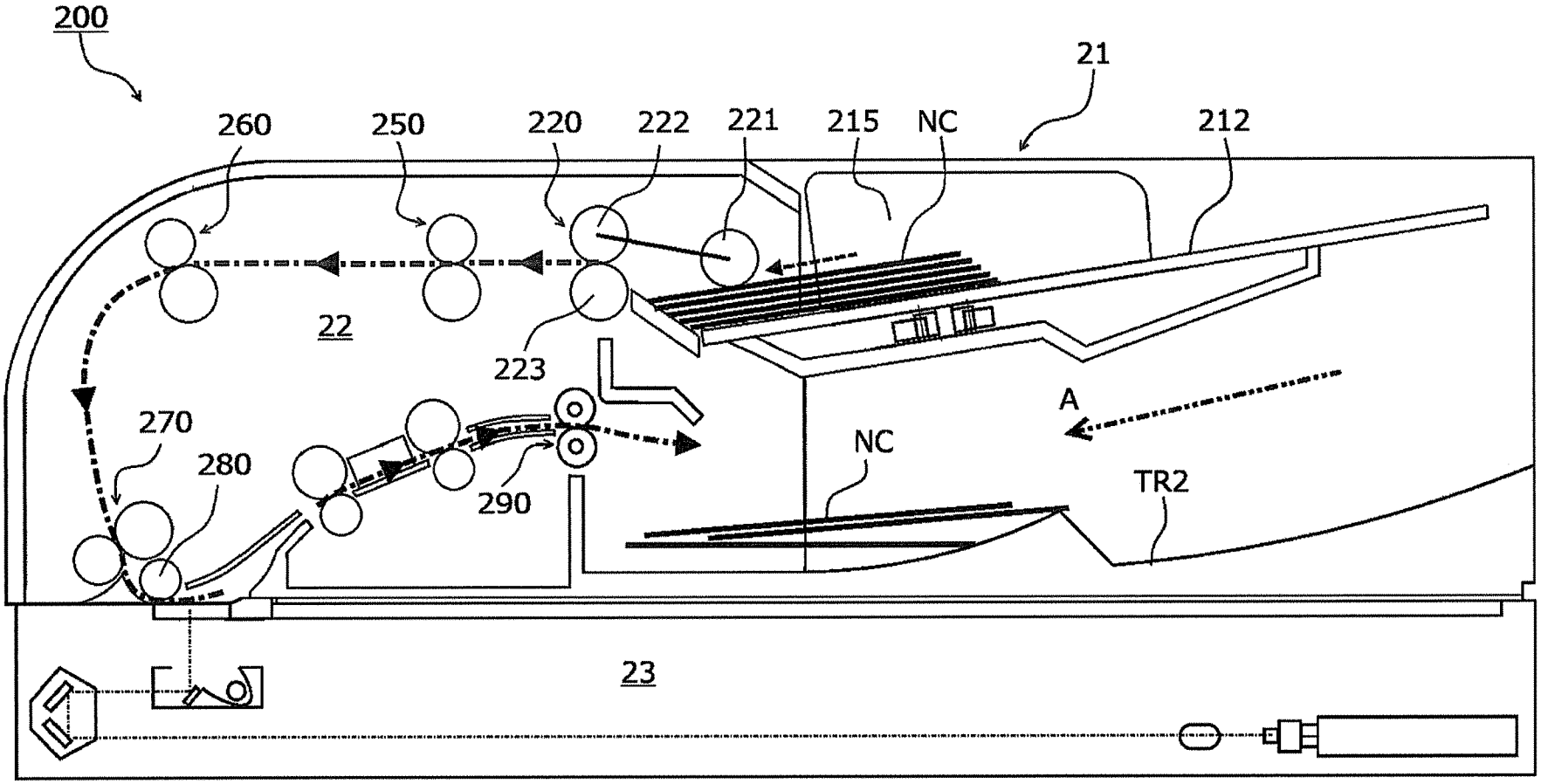
FIG. 10 illustrates how small-size sheets are transported and output to an output tray in an image reading device according to a comparative example not equipped with a sheet accommodation section.

FIG. 4 is a perspective view illustrating an output tray 216 of the image reading device 2. FIG. 5 is a cross-sectional view schematically illustrating how sheets S are transported in the image reading device 2. FIG. 6 is a perspective view illustrating a state where the sheet transport path G2 of the automatic sheet feeder 22 is exposed by raising the sheet load section 21 and the automatic sheet feeder 22 upward. FIG. 7 is a cross-sectional view schematically illustrating the image reading device 2 in a state where the sheet transport path G2 is exposed. FIG. 10 illustrates how small-size sheets are transported and output to an output tray TR2 in an image reading device 200 according to a comparative example not equipped with the sheet accommodation section 218.

The configuration and operation of an output unit will be described below with reference to the drawings.

FIG. 10 illustrates how small-size sheets are transported and output to the output tray TR2 in the image reading device 200 according to the comparative example not equipped with the sheet accommodation section 218.

As an example of sheets of a minimum size Smn, business cards NC are placed on the sheet tray 212. Side guides 215 are positioned at the opposite lateral edges of the business cards NC, and a reading process is commenced. The business cards NC on the sheet tray 212 are fed by the nudger roller 221 in a state where they are positioned in the width direction by the side guides 215, and are transported one-by-one to the image reader 23.

Each business card NC whose image is read by the image reader 23 is output by the output roller 290 to the output tray TR2 provided below the sheet load section 21. Unlike a normal sheet, a business card NC has a small size but has a large basis weight. As schematically shown in FIG. 10, the business cards NC tend to be output and stacked disorderly on the output tray TR2, possibly altering the proper order of the business cards NC. There is also a problem in that the stacked position of the output sheets is at the upstream side, in the sheet output direction, of the output tray TR2 covered by the sheet tray 212, thus making it difficult to access the stacked business cards NC (see an arrow A in FIG. 10).

The output tray 216 according to this exemplary embodiment is provided below the sheet tray 212 and receives sheets S output from the output roller 290 after the reading process. The output tray 216 is provided adjacent to an inner wall surface 217 at the downstream side in the sheet output direction with respect to the inner wall surface 217 provided below the output roller 290.

A sheet load surface 216*a* of the output tray 216 is provided with a sheet guide 216*b* that gently slopes downstream in the sheet output direction, so as to hold a sheet S output from the output roller 290 in a state where the sheet S is readily retrievable by a user.

The sheet load surface 216*a* of the output tray 216 is provided with a sheet accommodation section 218. The sheet accommodation section 218 is formed as a recess 218*a* extending downstream in the sheet output direction from the inner wall surface 217, such that the recess 218*a* is capable of accommodating sheets S of the predetermined minimum size Smn. Examples of sheets of the minimum size Smn in this exemplary embodiment include business cards NC and receipts RP.

The sheet load surface 216*a* of the output tray 216 is provided with ribs 216*c* at the opposite sides of the sheet accommodation section 218 in a direction intersecting the sheet output direction. The ribs 216*c* gently slope downstream in the sheet output direction along the recess 218*a* of the sheet accommodation section 218, so as to guide a sheet S of a size other than the minimum size Smn without causing the sheet S to fall into the recess 218*a* of the sheet accommodation section 218, and also to reduce the output resistance on the sheet load surface 216*a*.

FIG. 5 illustrates how small-size sheets and normal-size sheets are transported and output to the output tray 216 in the image reading device 2 having the sheet accommodation section 218 in the output tray 216.

When the business cards NC having the minimum width are placed on the sheet tray 212 of the sheet load section 21 and a reading process is commenced, the business cards NC on the sheet tray 212 are fed by the nudger roller 221 in a state where the business cards NC are positioned in the width direction by the side guides 215, and are transported one-by-one to the image reader 23.

Each business card NC whose image is read by the image reader 23 is output by the output roller 290 so as to be accommodated in the sheet accommodation section 218 provided in the sheet load surface 216*a* of the output tray 216. The sheet accommodation section 218 has the recess 218*a* and is provided with a gentle slope surface 218*c* at the downstream side thereof in the output direction. The business cards NC as small-size sheets are stacked in the recess 218*a* in a state where the proper order thereof is not altered and disorderly orientation of output sheets is suppressed.

As shown in FIG. 5, a sheet S having a size other than the minimum size Smn is guided by the sheet guide 216*b* from the ribs 216*c* provided at the opposite sides of the sheet accommodation section 218 in the direction intersecting the sheet output direction, so as to be stacked on the sheet load surface 216*a* of the output tray 216.

The sheet accommodation section 218 provided in the output tray 216 having such a configuration is integrated with a lower guide chute SH, serving as the lower surface of the sheet transport path G2 at the upstream side of the output roller 290 in the sheet transport direction, via the inner wall surface 217. With regard to the lower guide chute SH, as shown in FIG. 6, the lower guide chute SH is exposable in an accessible manner from the outside by exposing the sheet transport path G2 by opening the sheet load section 21 and the automatic sheet feeder 22 upward and rotating a control lever LV downward in a direction opposite to the stacking direction of the sheets S.

As shown in FIG. 7, the sheet accommodation section 218 has a rotation shaft 218*b* for exposing the sheet transport path G2 at the downstream side of the sheet accommodation section 218 in the output direction.

In detail, the rotation shaft 218*b* is provided at a position where the distance between the lower guide chute SH and the sheet accommodation section 218 is increasable to allow for retrieval of sheets S when a retrieval space RM for retrieving small-size sheets accommodated in the recess 218*a* by accessing the sheet accommodation section 218 from upstream in the transport direction of the sheets S is to be formed.

The lower guide chute SH serving as a surface of the sheet transport path G2 and the sheet accommodation section 218 provided in the output tray 216 are integrated with each other with the inner wall surface 217 interposed therebetween in this manner (indicated as a hatched area in FIG. 7), so that, by rotating the lower guide chute SH about the rotation shaft 218*b*, the retrieval space RM for accessing the sheet accommodation section 218 from upstream in the sheet transport direction may be formed.

Accordingly, in a case where business cards NC as small-size sheets are stacked in the sheet accommodation section 218, the control lever LV is operated to rotate the lower guide chute SH about the rotation shaft 218*b* in a state where the sheet load section 21 and the automatic sheet feeder 22 are opened upward, so that the sheet accommodation section 218 may be accessed from upstream in the sheet transport direction, whereby the business cards NC stacked in the sheet accommodation section 218 may be retrieved.

First Modification

Figure 8:
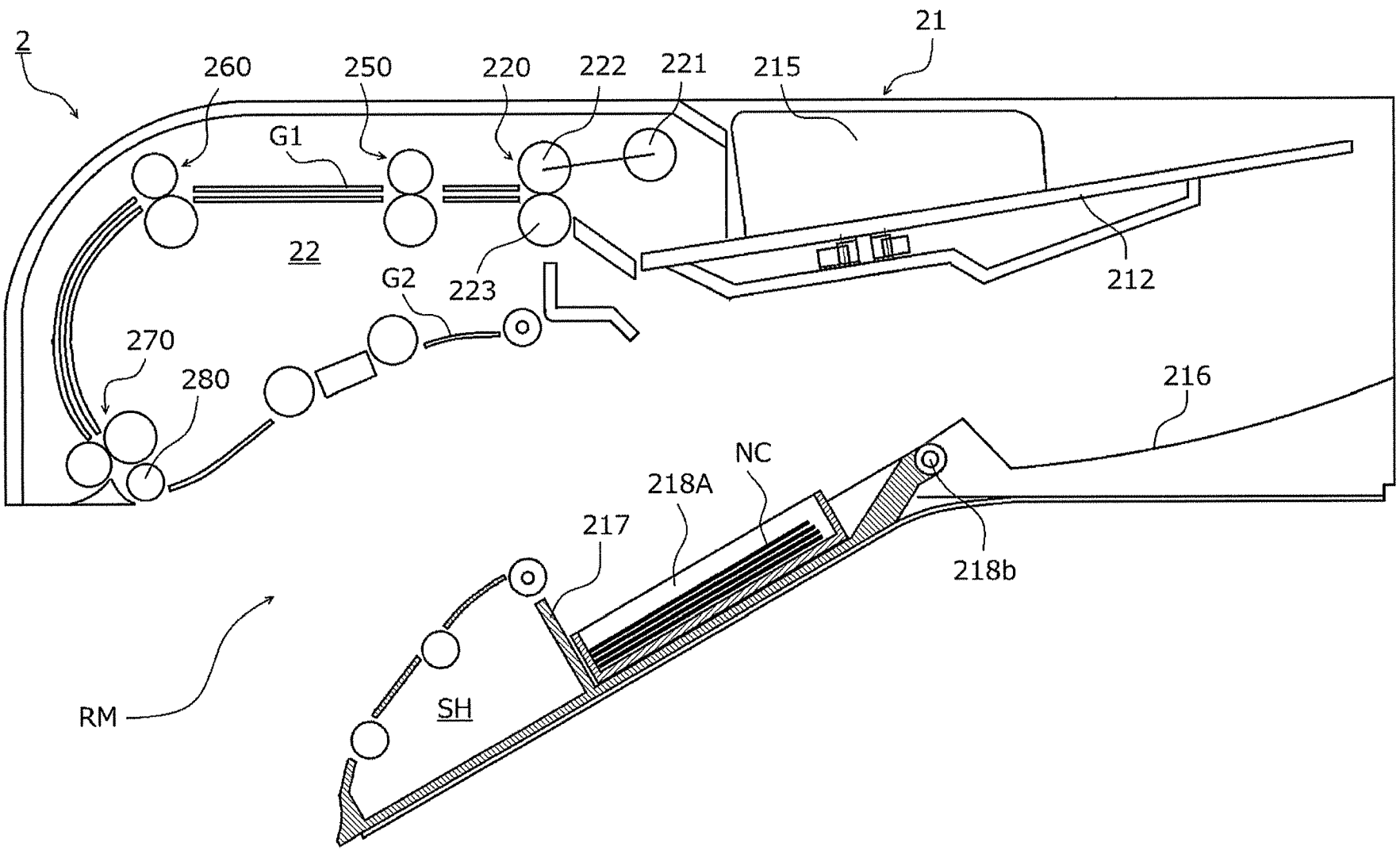
FIG. 8 is a cross-sectional view schematically illustrating how a sheet accommodation section according to a first modification is accessed in an image reading device having the sheet accommodation section.

FIG. 8 is a cross-sectional view schematically illustrating how a sheet accommodation section 218A according to a first modification is accessed in an image reading device 2 having the sheet accommodation section 218A.

The sheet accommodation section 218A according to the first modification is entirely box-shaped and is disposed in a detachable manner from the sheet load surface 216*a* of the output tray 216.

In a case where business cards NC as small-size sheets are stacked in the sheet accommodation section 218A, the lower guide chute SH is rotated about the rotation shaft 218*b* in a state where the sheet load section 21 and the automatic sheet feeder 22 are opened upward, so that the sheet accommodation section 218A may be accessed from upstream in the sheet transport direction, whereby the sheet accommodation section 218A accommodating the business cards NC may be retrieved.

Second Modification

Figure 9:
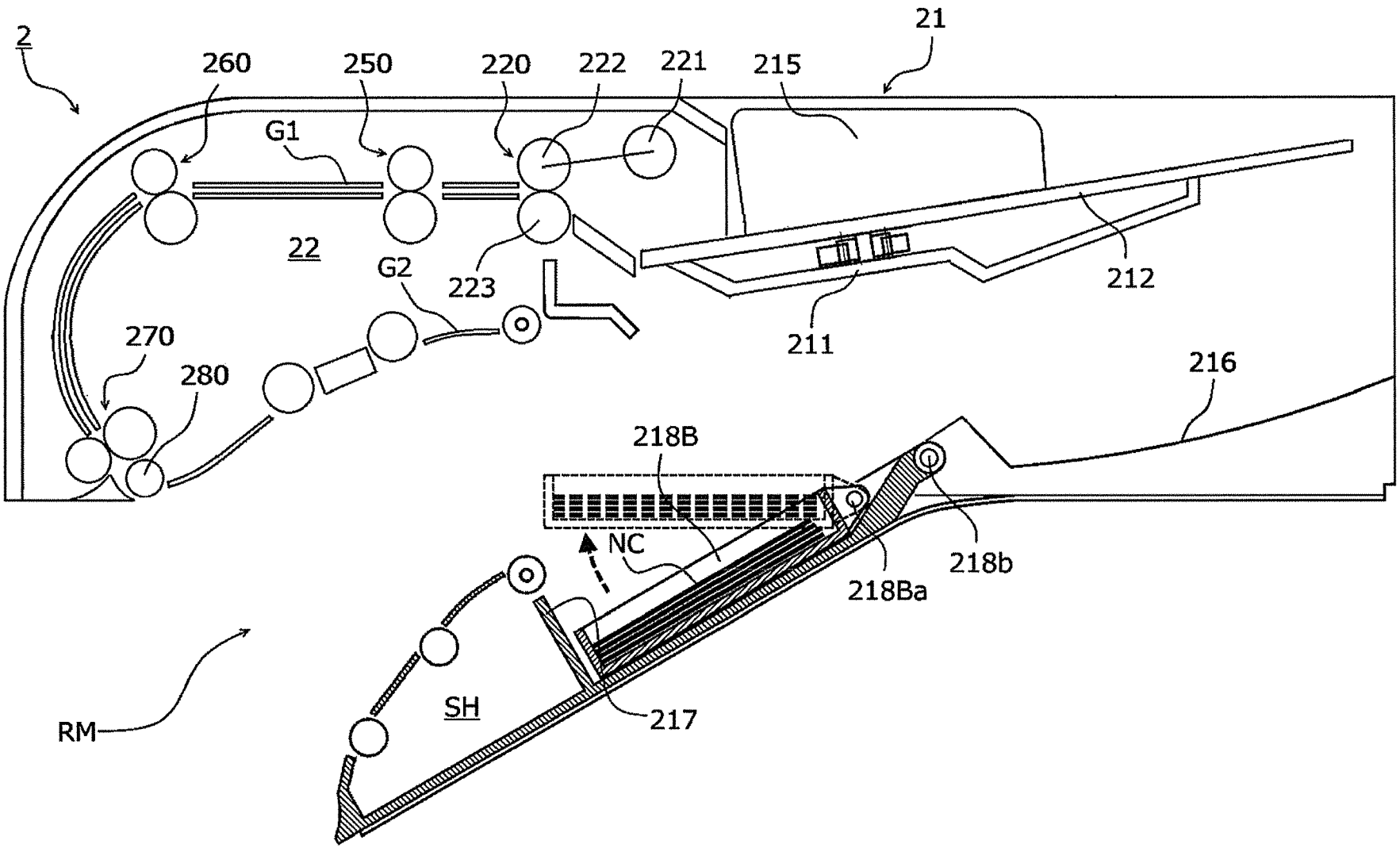
FIG. 9 is a cross-sectional view schematically illustrating how a sheet accommodation section according to a second modification is accessed in an image reading device having the sheet accommodation section.

FIG. 9 is a cross-sectional view schematically illustrating how a sheet accommodation section 218B according to a second modification is accessed in an image reading device 2 having the sheet accommodation section 218B.

The sheet accommodation section 218B according to the second modification is entirely box-shaped and is disposed in a liftable manner about a rotation shaft 218Ba relative to the sheet load surface 216*a* of the output tray 216. In particular, the sheet accommodation section 218B may have a latch mechanism that maintains the orientation of the sheet accommodation section 218B in a lifted state.

In a case where business cards NC as small-size sheets are stacked in the sheet accommodation section 218B, the lower guide chute SH is rotated about the rotation shaft 218Ba in a state where the sheet load section 21 and the automatic sheet feeder 22 are opened upward, so that the sheet accommodation section 218B may be accessed from upstream in the sheet transport direction, whereby the business cards NC stacked in the sheet accommodation section 218B may be retrieved more readily while the sheet accommodation section 218B is lifted.

In this exemplary embodiment, the sheet transport path G2 is exposed in the direction opposite to the stacking direction of the sheets S, so that the sheet accommodation section 218 provided on the output tray 216 covered by the sheet tray 212 is accessible without having to flip the sheet tray 212 upward, thereby facilitating the retrieval of the stacked small-size sheets.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transport device comprising:

a transport unit having a transport path along which a sheet read at a read position of an imaging unit is transported to an output unit, wherein the transport unit is configured to be disposed over the imaging unit;

an output tray on which the sheet output by the output unit is loaded; and a sheet accommodation section that is disposed downstream in an output direction of the sheet, which is read at the read position, from an inner wall surface extending upward adjacent to the output tray and that has a recess capable of accommodating a sheet of a predetermined minimum size, wherein the sheet accommodation section is disposed upstream of the output tray in the output direction, wherein the sheet accommodation section and the output tray are disposed downstream of the read position, wherein a retrieval space through which the sheet accommodated in the sheet accommodation section is retrievable is provided by exposing the transport path in a direction opposite to a loading direction of the sheet, and the exposed transport path is located at a space between the transport unit and the imaging unit, wherein an entirety of the sheet accommodation section is configured to rotate to expose the transport path so as to form the retrieval space.

2. The sheet transport device according to claim 1, wherein a rotation shaft is provided downstream of the sheet accommodation section in the output direction, the rotation shaft being provided at a position where a distance between the transport path and the sheet accommodation section is increasable as the sheet accommodation section rotates about the rotation shaft to expose the transport path, thereby allowing retrieval of the sheet from upstream in a transport direction in which the sheet is transported.

3. The sheet transport device according to claim 2, wherein the sheet accommodation section is detachable from the output tray.

4. The sheet transport device according to claim 3, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

5. The sheet transport device according to claim 2, wherein the sheet accommodation section is liftable from the output tray.

6. The sheet transport device according to claim 5, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

7. The sheet transport device according to claim 2, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

8. The sheet transport device according to claim 1, wherein the sheet accommodation section is detachable from the output tray.

9. The sheet transport device according to claim 8, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

10. The sheet transport device according to claim 1, wherein the sheet accommodation section is liftable from the output tray.

11. The sheet transport device according to claim 10, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

12. The sheet transport device according to claim 1, wherein an upper surface of the output tray is provided with ribs at opposite sides of the sheet accommodation section in a direction intersecting the output direction of the sheet, the ribs protruding in a direction opposite to the loading direction and extending parallel to the output direction of the sheet.

13. An image reading device comprising:

an imaging unit that reads an image of a sheet; and the sheet transport device according to claim 1 that transports the sheet to a read position where the imaging unit reads the sheet.

14. An image forming apparatus comprising:

the image reading device according to claim 13 that reads an image of a sheet; and an image recorder that records the image read by the image reading device onto a recording medium.

15. The sheet transport device according to claim 1, wherein the output unit comprises a pair of output rollers, and the pair of output rollers are separated from each other in a state where the sheet accommodation section is rotated to expose the transport path.

* * * * *